US008118567B2

(12) United States Patent
Mori et al.

(10) Patent No.: US 8,118,567 B2
(45) Date of Patent: Feb. 21, 2012

(54) SWASH PLATE TYPE PISTON PUMP MOTOR

(75) Inventors: Takashi Mori, Kobe (JP); Yasuo Ohmi, Kobe (JP); Hideki Okado, Kobe (JP)

(73) Assignee: Kabushiki Kaisha Kawasaki Precision Machinery, Kobe-shi (JP)

( * ) Notice: Subject to any disclaimer, the term of this patent is extended or adjusted under 35 U.S.C. 154(b) by 166 days.

(21) Appl. No.: 12/518,872

(22) PCT Filed: Dec. 15, 2006

(86) PCT No.: PCT/JP2006/325049

§ 371 (c)(1),
(2), (4) Date: Jun. 11, 2009

(87) PCT Pub. No.: WO2008/072338

PCT Pub. Date: Jun. 19, 2008

(65) Prior Publication Data

US 2010/0018385 A1 Jan. 28, 2010

(51) Int. Cl.

| | |
|---|---|
| ***F04B 1/12*** | (2006.01) |
| ***B23P 15/00*** | (2006.01) |
| ***F01B 3/02*** | (2006.01) |
| ***F01B 13/04*** | (2006.01) |
| ***F01B 31/00*** | (2006.01) |

(52) U.S. Cl. ..... 417/269; 29/888.02; 92/12.2; 92/153

(58) Field of Classification Search ..... 417/222.1, 417/222.2, 221, 269; 92/12.2, 153, 157, 92/DIG. 2; 29/888.02

See application file for complete search history.

(56) References Cited

U.S. PATENT DOCUMENTS

| | | | | |
|---|---|---|---|---|
| 4,627,330 | A * | 12/1986 | Beck, Jr. | 92/12.2 |
| 2005/0147503 | A1 * | 7/2005 | Kurita et al. | 417/222.1 |

FOREIGN PATENT DOCUMENTS

| | | | |
|---|---|---|---|
| JP | 59-231179 | | 12/1984 |
| JP | 62-133016 | | 6/1987 |
| JP | 02-173212 | | 7/1990 |
| JP | 08-003644 | | 1/1996 |
| JP | 08-334081 | | 12/1996 |
| JP | 08334081 | * | 12/1996 |
| JP | 11-050951 | | 2/1999 |
| JP | 2001-132757 | A | 5/2001 |
| JP | 2006-291879 | | 10/2006 |
| WO | WO2006070736 | * | 12/2005 |

OTHER PUBLICATIONS

ISA JPO; International Search Report of PCT/JP2006/325049; Feb. 6, 2007; Japan; 2 pages.

* cited by examiner

*Primary Examiner* — Devon C Kramer
*Assistant Examiner* — Bryan Lettman
(74) *Attorney, Agent, or Firm* — Alleman Hall McCoy Russell & Tuttle LLP

(57) ABSTRACT

A swash plate type piston pump motor is configured such that: a plurality of pistons are arranged in a circumferential direction in a cylinder block configured to rotate with a rotating shaft; the pistons reciprocate such that tip end portions thereof are guided by a smooth surface of a swash plate; and the swash plate is slidably supported by a concave surface of a swash plate support of a convex surface to be able to tilt with respect to a rotating axis, and concave surfaces and of the swash plate support include quenched portions which are partially quenched by laser light.

4 Claims, 8 Drawing Sheets

SWASH PLATE TYPE PISTON PUMP MOTOR

TECHNICAL FIELD

The present invention relates to a swash plate type piston pump motor in which a swash plate is supported by a swash plate support so as to be able to tilt with respect to a rotating shaft.

BACKGROUND ART

A typical cradle swash plate type piston pump is configured such that: a rear surface of a swash plate projects in a circular-arc shape; a casing or a swash plate support is formed to have a circular-arc support surface to support the circular-arc rear surface of the swash plate; and a tilt angle of the swash plate with respect to a rotating shaft changes by tilting the swash plate while introducing lubricating oil to the support surface, thereby adjusting the amount of hydraulic oil discharged (see Japanese Laid-Open Patent Application Publication Hei 11-50951 for example). Specifically, this type of piston pump includes a plurality of pistons arranged in a circumferential direction in a cylinder block disposed in the casing. When the cylinder block rotates by rotation of the rotating shaft, the pistons reciprocate while tip end portions thereof are guided along the swash plate, thereby sucking/discharging the hydraulic oil. At this time, the increase in the tilt angle of the swash plate increases the stroke of the piston, thereby increasing the amount of hydraulic oil discharged, whereas the decrease in the tilt angle of the swash plate decreases the stroke of the piston, thereby decreasing the amount of hydraulic oil discharged.

In the foregoing swash plate type piston pump, since a reaction force applied by the hydraulic oil to the pistons when the pistons move back into the cylinder block and discharge the hydraulic oil acts on the swash plate, a surface pressure between the swash plate and the swash plate support becomes very high. Therefore, a lubricating oil film at an interface between the swash plate and the swash plate support tends to run out. On this account, slide surfaces of the swash plate and the swash plate support require seizing resistance and abrasion resistance. Conventionally, the seizing resistance and the abrasion resistance are given to the swash plate and the swash plate support, made of cast iron, by gas nitrocarburizing which causes nitrogen to diffusively intrude into the swash plate and the swash plate support to harden those surfaces.

(A piston pump sucks/discharges the hydraulic oil using the pistons by utilizing, as an input, a driving force applied to the rotating shaft. A piston motor has the same basic configuration as the piston pump except that the piston motor outputs the driving force of the rotating shaft by utilizing, as an input, inflowing/outflowing pressure oil. Therefore, the piston pump is referred to as a piston pump motor in the present description.)

DISCLOSURE OF THE INVENTION

Problems to be Solved by the Invention

The seizing resistance and the abrasion resistance may be given to only the slide surfaces of the swash plate and the swash plate support. However, in the case of carrying out a surface treatment by the gas nitrocarburizing, whole parts are subjected to the gas nitrocarburizing, so that large-scale equipment is required for mass production. In addition, since whole parts are heated at high temperature (about 570° C.) in the gas nitrocarburizing, they need to be subjected to annealing to relieve stress before the gas nitrocarburizing to prevent heat deformation. Further, since a plurality of parts are subjected to batch processing at one time in the gas nitrocarburizing in consideration of work efficiency, a production lead time may become long. Furthermore, since the gas nitrocarburizing becomes unstable if the surfaces of the parts are not cleaned, a pretreatment to clean the parts is required.

An object of the present invention is to increase the seizing resistance and the abrasion resistance of the slide surfaces while improving the productivity.

Means for Solving the Problems

The present invention was made in light of the above-described circumstances, and a swash plate type piston pump motor according to the present invention is a swash plate type piston pump motor in which: a plurality of pistons are arranged in a circumferential direction in a cylinder block configured to rotate with a rotating shaft; the pistons reciprocate such that tip end portions thereof are guided along a smooth surface of a swash plate; and the swash plate is supported by a swash plate support so as to be able to tilt with respect to the rotating shaft, wherein any one of a slide surface of the swash plate support and a slide surface of the swash plate includes a quenched portion partially quenched by laser light.

With this, since the quenched portion partially formed by utilizing high directivity of the laser light becomes convex by heat expansion, the quenched portion and the non-quenched portion form projections and depressions. Therefore, a contact property and a sliding property improve, and the seizing resistance increases. In addition, only the slide surface of the swash plate support or the swash plate may be quenched by the laser light. Therefore, the abrasion resistance can be cleanly given to the slide surface by small-scale equipment in a short period of time. Further, since this quenching is selective quenching whose case depth is shallow, the heat deformation is unlikely to occur, so that finishing processing can be omitted. Moreover, the laser quenching can be carried out in the atmosphere and does not require cooling liquid. Further, since the quenched surface only has to have a certain absorption ratio of the laser light, it is unnecessary to pay too much attention to cleanliness of surfaces of parts as in the case of the gas nitrocarburizing. Therefore, inline processing can be carried out in a production line of the piston pump motor. Thus, the seizing resistance and the abrasion resistance of the slide surface of the swash plate support or the swash plate can be increased while significantly improving the productivity.

The quenched portion may be formed in a stripe pattern. With this, since a plurality of the quenched portions which become convex by the heat expansion caused by the laser light are formed to be spaced apart from each other, the surface pressure between the swash plate and the swash plate support is effectively distributed, so that the swash plate and the swash plate support tend to smoothly contact each other. Thus, the seizing resistance improves.

Respective lines of the quenched portion may extend in a direction perpendicular to a slide direction in which the swash plate slides on the swash plate support. With this, when the swash plate tilts and slides with respect to the swash plate support, the quenched portion and the non-quenched portion alternately contact the surface which slides on the surface on which the quenched portion is formed. Therefore, the seizing resistance further improves.

The quenched portion may be formed as a plurality of spots. With this, since the swash plate and the swash plate support point-contact each other, the surface pressure between the swash plate and the swash plate support is effectively distributed, so that the swash plate and the swash plate support tend to smoothly contact each other. Thus, the seizing resistance improves. Note that the shape of the spot may be circular, oval, or the like.

The slide surface including the quenched portion further includes a quenched portion surrounding the quenched portion and a non-quenched portion. With this, the lubricating oil at an interface between the swash plate and the swash plate support is stuck in the non-quenched portion that serves as a recess formed inside the surrounding quenched portion. Therefore, the non-quenched portion achieves an effect of keeping the oil film, and the oil film can be prevented from running out at the interface between the swash plate and the swash plate support.

EFFECTS OF THE INVENTION

As is clear from the foregoing explanation, in accordance with the present invention, by causing any one of the slide surface of the swash plate support and the slide surface of the swash plate to be subjected to selective quenching using laser light, the seizing resistance and the abrasion resistance of the slide surface of the swash plate support or the swash plate are increased while significantly improving the productivity of the piston pump motor.

BRIEF DESCRIPTION OF THE DRAWINGS

FIG. 2(*b*) is a cross-sectional view taken along line A-A.

FIG. 3(*b*) is a cross-sectional view taken along line B-B.

FIG. 5(*b*) is a cross-sectional view taken along line C-C.

BEST MODE FOR CARRYING OUT THE INVENTION

Hereinafter, embodiments according to the present invention will be explained in reference to the drawings.

Embodiment 1

Figure 1:
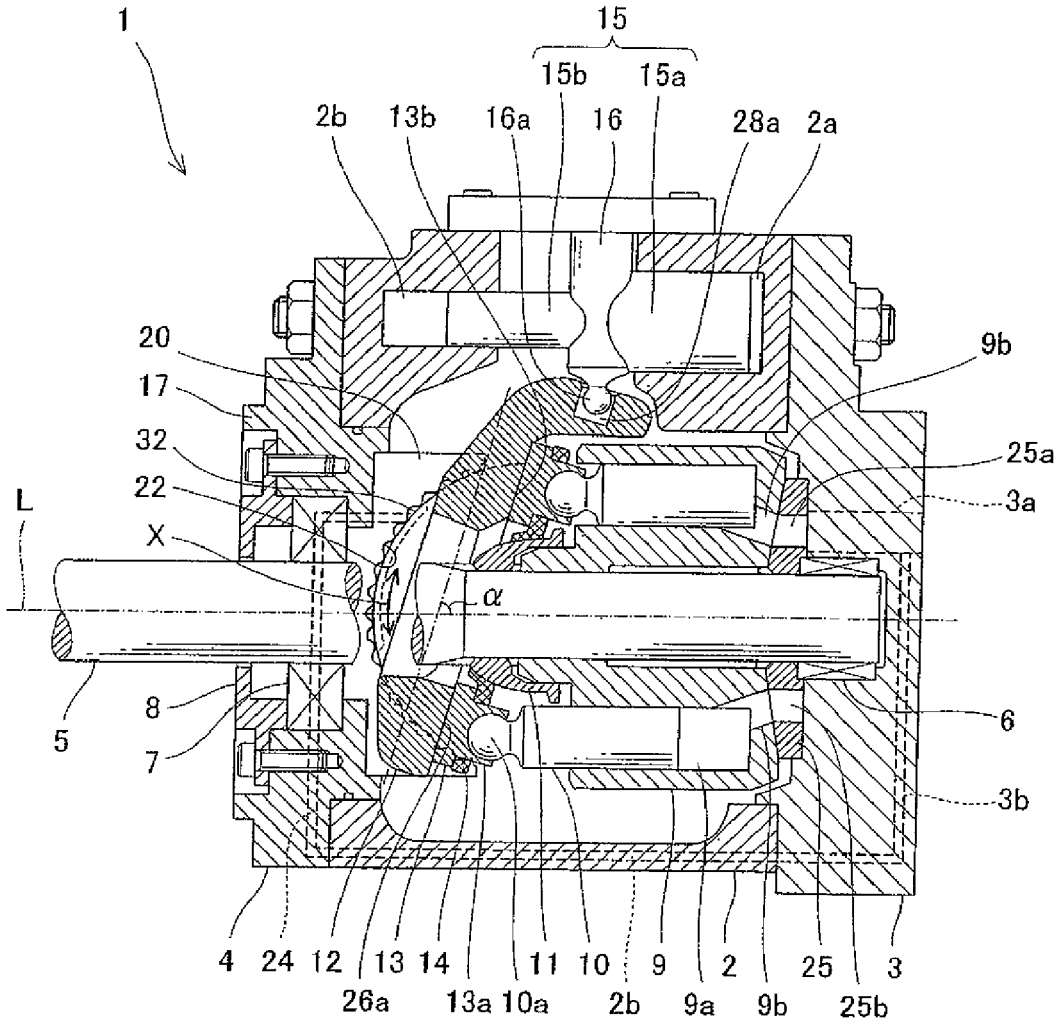
FIG. 1 is a cross-sectional view of a cradle swash plate type piston pump motor according to Embodiment 1 of the present invention.

FIG. 1 is a cross-sectional view of a cradle swash plate type piston pump motor 1 according to Embodiment 1. As shown in FIG. 1, the swash plate type piston pump motor 1 includes: a substantially tubular casing main body 2; a valve cover 3 which closes a right opening of the casing main body 2 and includes a discharging passage 3*a* and a sucking passage (not shown); and a swash plate support 4 which closes a left opening of the casing main body 2. A rotating shaft 5 rotatably supported by the valve cover 3 and the swash plate support 4 via bearings 6 and 7 is disposed in the casing main body 2 so as to extend in a crosswise direction, and a holding member 8 is attached outside the bearing 7 internally fitting the swash plate support 4. A cylinder block 9 is splined to the rotating shaft 5, and rotates integrally with the rotating shaft 5. A plurality of piston chambers 9*a* are concavely formed on the cylinder block 9 so as to be equally spaced apart from one another in a circumferential direction about a rotating axis L of the rotating shaft 5. Each of the piston chambers 9*a* is formed in parallel with the rotating axis L, and stores a piston 10 which reciprocates.

A tip end portion 10*a* of the piston 10 projecting from the piston chamber 9*a* is spherical, and is rotatably attached to a fit recess 13*a* of a shoe 13. Moreover, a receiving seat 11 of the shoe 13 externally fits a left tip end of the cylinder block 9. A swash plate 12 is disposed to face a contact surface 13*b* of the shoe 13 located opposite the fit recess 13*a* of the shoe 13. The shoe 13 is pressed toward the swash plate 12 side by causing a pressing plate 14 to fit the shoe 13 from the cylinder block 9 side. The swash plate 12 includes a flat smooth surface 26*a* facing the contact surface 13*b* of the shoe 13. When the cylinder block 9 rotates, the shoe 13 is guided by and along the smooth surface 26*a* to rotate, and the pistons 10 reciprocate in a direction of the rotating axis L. A circular-arc convex surface 32 is formed on a surface opposite the smooth surface 26*a* of the swash plate 12, and the convex surface 32 is slidably supported by a circular-arc concave surface 22 of the swash plate support 4.

A large-diameter cylinder chamber 2*a* and a small-diameter cylinder chamber 2*b* are coaxially formed at an upper portion of the casing main body 2 so as to be opposed to each other in the crosswise direction. A large-diameter portion 15*a* of a tilt adjustment piston 15 is stored in the large-diameter cylinder chamber 2*a*, and a small-diameter portion 15*b* of the tilt adjustment piston 15 is stored in the small-diameter cylinder chamber 2*b*. A coupling member 16 penetrates and is fixed to a central portion of the tilt adjustment piston 15, and a lower end side spherical portion 16*a* of the coupling member 16 rotatably fits an upper recess 28*a* of the swash plate 12. Then, in a state where a normal pressure is supplied to the small-diameter cylinder chamber 2*b*, a pressure supplied to the large-diameter cylinder chamber 2*a* is increased or decreased by a regulator (not shown) to cause the tilt adjustment piston 15 to slide in the crosswise direction. Thus, the convex surface 32 of the swash plate 12 slides on the concave surface 22 of the swash plate support 4 in a slide direction X, and this changes a tilt angle $\alpha$ of the swash plate 12 with respect to the rotating axis L.

A valve plate 25 which slides on the cylinder block 9 is attached to an inner surface side of the valve cover 3. The valve plate 25 includes an outlet port 25*a* and an inlet port 25*b*. An oil passage 9*b* communicated with the cylinder chamber 9*a* of the cylinder block 9 is communicated with the outlet port 25*a* or the inlet port 25*b* depending on an angular position of the cylinder block 9. The valve cover 3 includes: the discharging passage 3*a* which is communicated with the outlet port 25*a* of the valve plate 25 and opens on an outer surface of the valve cover 3; and the sucking passage (not shown) which is communicated with the inlet port 25*b* and opens on the outer surface of the valve cover 3. The valve cover 3 further includes a bypass passage 3*b* branched from the discharging passage 3*a*. The bypass passage 3*b* is communicated with a relay passage 2*b* of the casing main body 2, and the relay passage 2*b* is communicated with a below-described oil supplying passage 24 of the swash plate support 4.

Figure 2A:
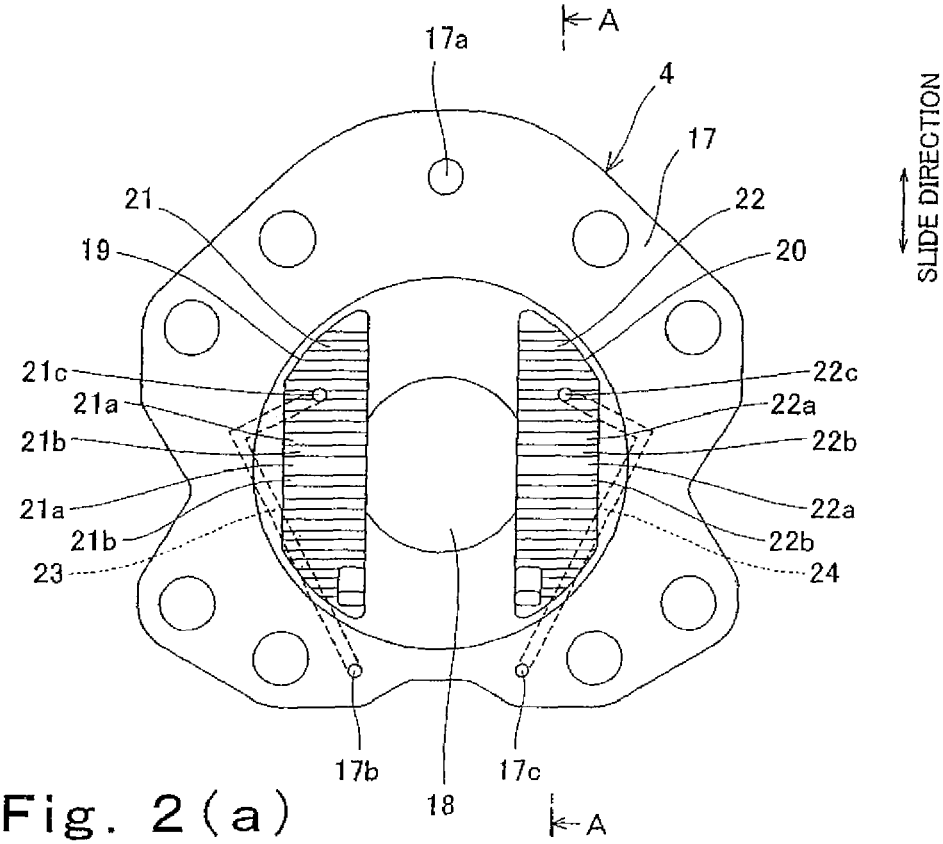
FIG. 2(*a*) is a plan view of a swash plate support of the cradle swash plate type piston pump motor shown in FIG. 1.
Figure 2B:
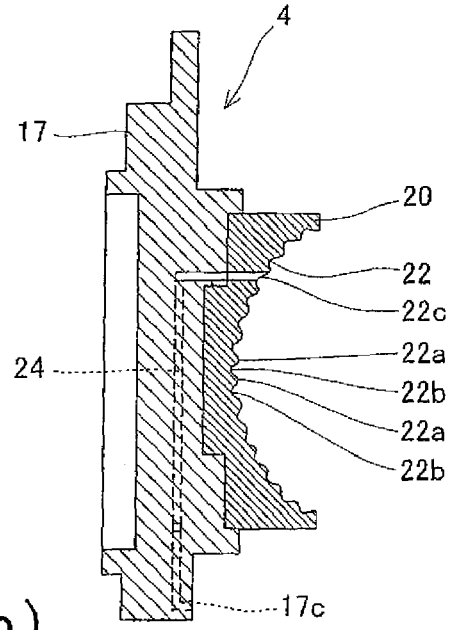

FIG. 2(*a*) is a plan view of the swash plate support 4 of the swash plate type piston pump motor 1, and FIG. 2(*b*) is a cross-sectional view taken along line A-A. As shown in FIGS.

2(*a*) and 2(*b*), the swash plate support 4 is made of cast iron for example, an insertion hole 18 through which the rotating shaft 5 is inserted is formed at the center of a plate portion 17 of the swash plate support 4, and a bolt hole 17*a* is formed at a predetermined outer peripheral side position. A pair of slide receiving portions 19 and 20 are convexly formed on both sides, respectively, of the insertion hole 18 of the plate portion 17. Surfaces of the slide receiving portions 19 and 20 which surfaces face the swash plate 12 are circular-arc concave surfaces 21 and 22 (slide surfaces), respectively. Quenched portions 21*a* and 22*a* are formed on the concave surfaces 21 and 22, respectively, in a stripe pattern. The quenched portions 21*a* and 22*a* are formed by irradiating the concave surfaces 21 and 22 with laser light in a stripe pattern in a direction perpendicular to the slide direction using a laser irradiation device (not shown), such as carbon dioxide laser, YAG laser, solid state laser, or semiconductor laser. With this, the quenched portions 21*a* and 22*a* becomes convex by expansion caused by structural transformation. Thus, the quenched portions 21*a* and 22*a* and non-quenched portions 21*b* and 22*b* form projections and depressions. Moreover, the concave surfaces 21 and 22 include pressure oil supply ports 21*c* and 22*c*, respectively, which open and face below-described groove portions 33 and 34, respectively, convex surfaces 31 and 32 of the swash plate 12. The pressure oil supply ports 21*c* and 22*c* are communicated with oil introducing ports 17*b* and 17*c*, respectively, via oil supplying passages 23 and 24. The oil introducing ports 17*b* and 17*c* open at a lower portion of the plate portion 17, and the oil supplying passages 23 and 24 are formed inside the swash plate support 4. The oil introducing ports 17*b* and 17*c* are communicated with the relay passage 2*b* of the casing main body 2, so that the oil is supplied to the concave surfaces 21 and 22 as the lubricating oil.

Figure 3A:
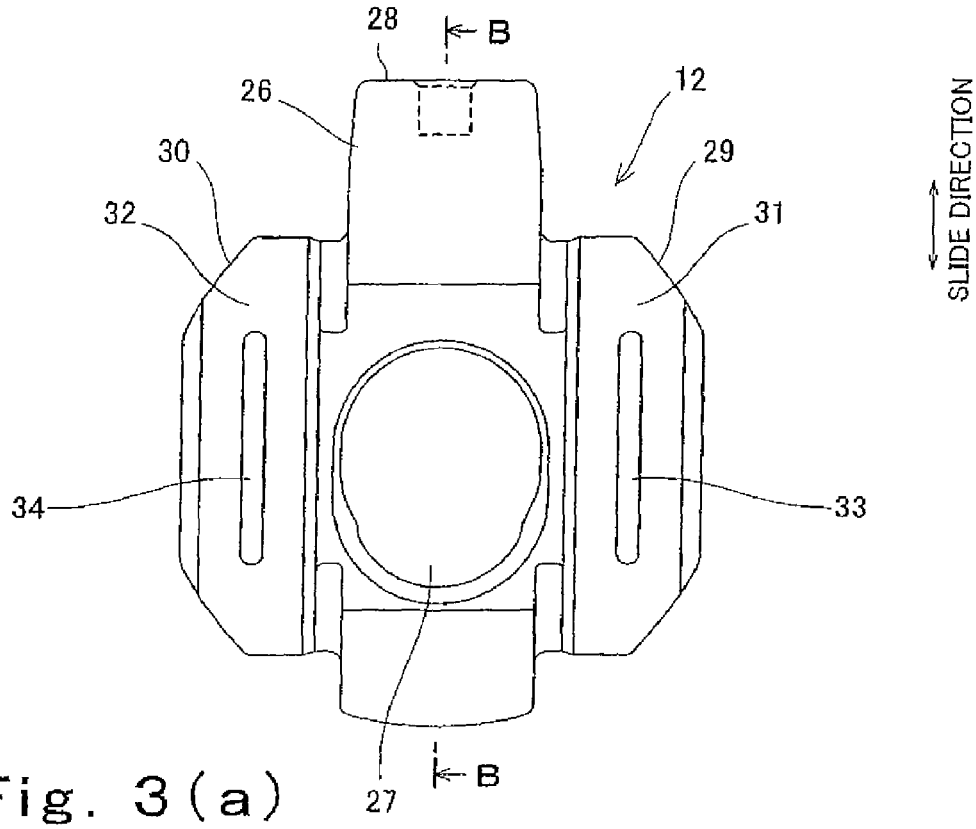
FIG. 3(*a*) is a plan view of a swash plate of the cradle swash plate type piston pump motor shown in FIG. 1.
Figure 3B:
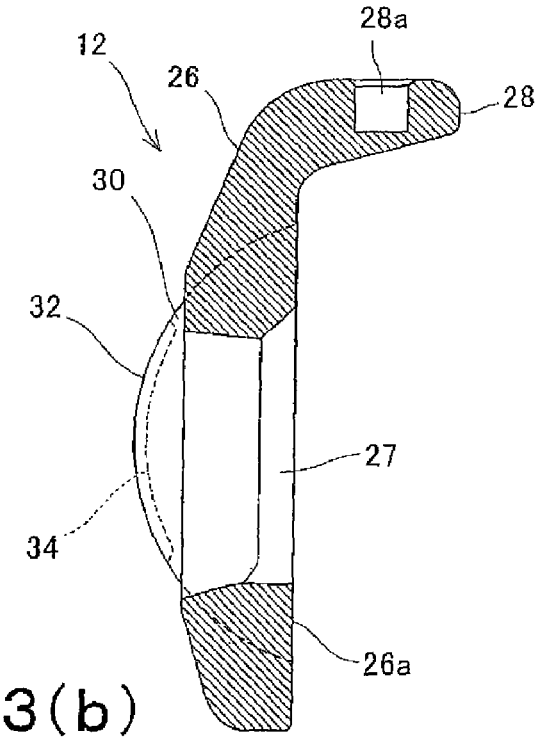

FIG. 3(*a*) is a plan view of the swash plate 12 of the swash plate type piston pump motor 1, and FIG. 3(*b*) is a cross-sectional view taken along line B-B. As shown in FIGS. 3(*a*) and 3(*b*), the swash plate 12 is made of cast iron which is subjected to, for example, the gas nitrocarburizing which causes nitrogen to diffusively intrude into the cast iron to harden its surface, and includes: a swash plate main body 26 having the smooth surface 26*a* which guides the shoe 13; and a pair of slide pressing portions 29 and 30 formed at both end portions of the swash plate main body 26 in a width direction perpendicular to a longitudinal direction of the swash plate main body 26. An insertion hole 27 through which the rotating shaft 5 is inserted is formed at the center of the swash plate main body 26. Surfaces of the slide pressing portions 29 and 30 which surfaces face the concave surfaces 21 and 22, respectively, of the swash plate support 4 are circular-arc smooth convex surfaces. Oil film keeping groove portions 33 and 34 are concavely formed at the centers, respectively, of the slide pressing portions 29 and 30 in the width direction so as to extend in the slide direction.

As shown in FIG. 1, in accordance with the operations of the swash plate type piston pump motor 1, the rotating shaft 5 is driven to rotate, and the cylinder block 9 rotates with the rotating shaft 5. Then, the piston 10 moving downward is guided by the swash plate 12 to be pulled out from the piston chamber 9*a*, so that the hydraulic oil is sucked into this piston chamber 9*a*, whereas the piston 10 moving upward is guided by the swash plate 12 to be pushed into the piston chamber 9*a*, so that the hydraulic oil in this piston chamber 9*a* is discharged. At this time, the convex surfaces 31 and 32 of the swash plate 12 are caused to slide along the concave surfaces 21 and 22, respectively, of the swash plate support 4 via the lubricating oil to adjust the tilt angle $\alpha$ of the swash plate 12. Thus, the amount of stroke of the piston 10 is changed, so that the amount of oil discharged can be adjusted.

With the above configuration, the quenched portions 21*a* and 22*a* formed in a stripe pattern by utilizing the laser light become convex by the expansion caused by the structural transformation, so that the quenched portions 21*a* and 22*a* and the non-quenched portions 21*b* and 22*b* form projections and depressions. Therefore, a sliding property improves, and the seizing resistance increases. At this time, since the quenched portions 21*a* and 22*a* are formed in a stripe pattern to extend in a direction perpendicular to the slide direction, the quenched portion 21*a* and the non-quenched portion 21*b* alternately contact the convex surface 31 of the swash plate 12 when the swash plate 12 slides, and the quenched portion 22*a* and the non-quenched portion 22*b* alternately contact the convex surface 32 of the swash plate 12 when the swash plate 12 slides. Therefore, the surface pressure between the swash plate 12 and the swash plate support 4 is effectively distributed, so that the swash plate 12 and the swash plate support 4 tend to smoothly contact each other. Thus, the seizing resistance improves. In addition, only the concave surfaces 21 and 22 of the swash plate support 4 may be quenched by the laser light. Therefore, the abrasion resistance of slide portions can be cleanly increased by small-scale equipment in a short period of time. Moreover, since this quenching is selective quenching whose case depth is shallow, the heat deformation is unlikely to occur, so that finishing processing can be omitted. Moreover, since the quenched surface only has to have a certain absorption ratio of the laser light, it is unnecessary to pay too much attention to cleanliness of surfaces of parts as in the case of the gas nitrocarburizing. Therefore, inline processing can be carried out in a production line of the piston pump motor 1. Thus, the seizing resistance and the abrasion resistance of the swash plate support 4 can be increased while significantly improving the productivity.

The present embodiment has explained the operations of the swash plate type piston pump in which the rotational driving force of the rotating shaft 5 is used as an input and sucking/discharging of the hydraulic oil by the piston 10 is carried out as an output. However, the present embodiment may be used as a swash plate type piston motor in which inflowing/outflowing of the pressure oil to/from the cylinder chamber 9*a* is used as an input and the rotation of the rotating shaft 5 is carried out as an output.

Embodiment 2

Figure 4:
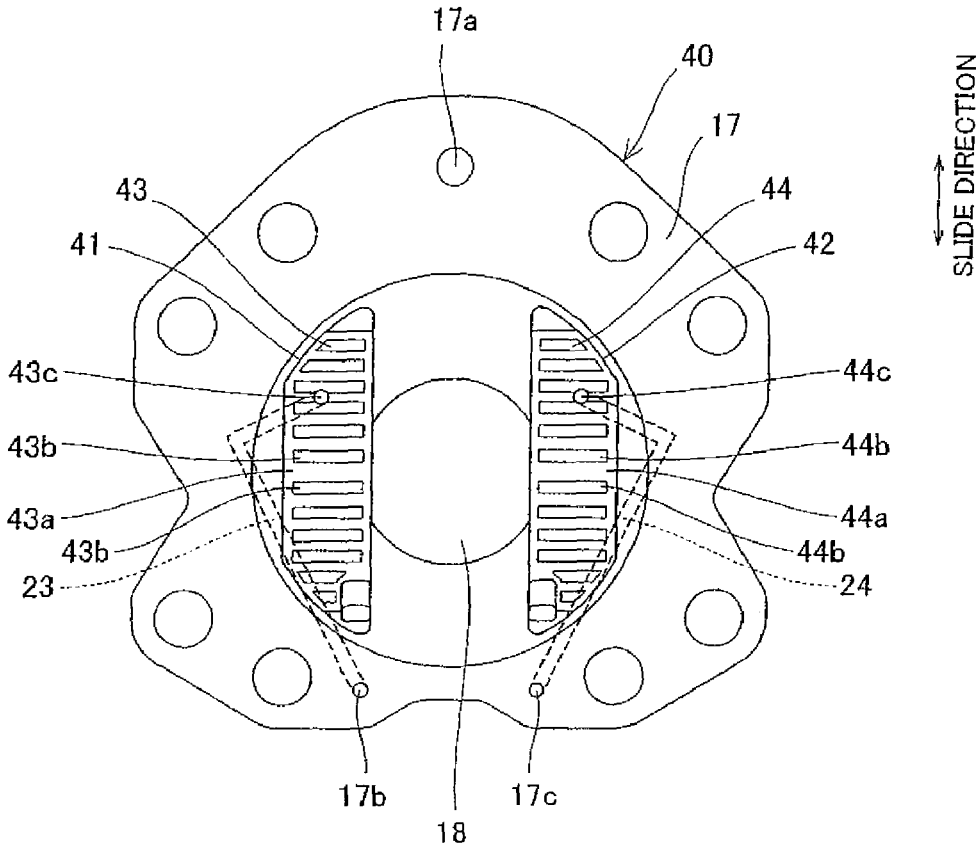
FIG. 4 is a plan view of the swash plate support of Embodiment 2.

Next, Embodiment 2 will be explained. FIG. 4 is a plan view of a swash plate support 40 of Embodiment 2. The difference between Embodiments 1 and 2 is the pattern of each of quenched portions 43*a* and 44*a* of concave surfaces 43 and 44 of the swash plate support 40.

As shown in FIG. 4, in the swash plate support 40 of the present embodiment, a pair of slide receiving portions 41 and 42 are convexly formed on both sides, respectively, of the insertion hole 18 of the plate portion 17, and circular-arc concave surfaces 43 and 44 (slide surfaces) of the slide receiving portions 41 and 42 are subjected to pattern irradiation with the laser light, so that the quenched portions 43*a* and 44*a* are formed on the concave surfaces 43 and 44, respectively. The quenched portions 43*a* and 44*a* are formed in a stripe pattern to extend in a direction (width direction) perpendicular to the slide direction, and also extend along outer peripheries, respectively, of the concave surfaces 43 and 44 so as to surround the above stripe-pattern portion. By patterning the quenched portions 43*a* and 44*a* as above, non-quenched portions 43*b* and 44*b* are surrounded by the quenched portions 43*a* and 44*a*, respectively, to be formed in a stripe pattern. That is, respective lines of each of the non-quenched portions 43*a* and 44*a* are spaced apart from each other to extend in a direction perpendicular to the slide direction.

With the above configuration, the lubricating oil at an interface between the convex surface 31 of the swash plate 12 and the concave surface 43 of the swash plate support 40 and at an interface between the convex surface 32 of the swash plate 12 and the concave surface 44 of the swash plate support 40 is stuck in the non-quenched portions 43*b* and 44*b* that serve as recesses. Therefore, the non-quenched portions 43*b* and 44*b* achieve an effect of keeping an oil film, and the oil film is prevented from being damaged. Thus, the seizing resistance improves. The other configuration of Embodiment 2 is the same as that of Embodiment 1, so that the same reference numbers are used for the same components, and explanations of those components are omitted.

Embodiment 3

Figure 5A:
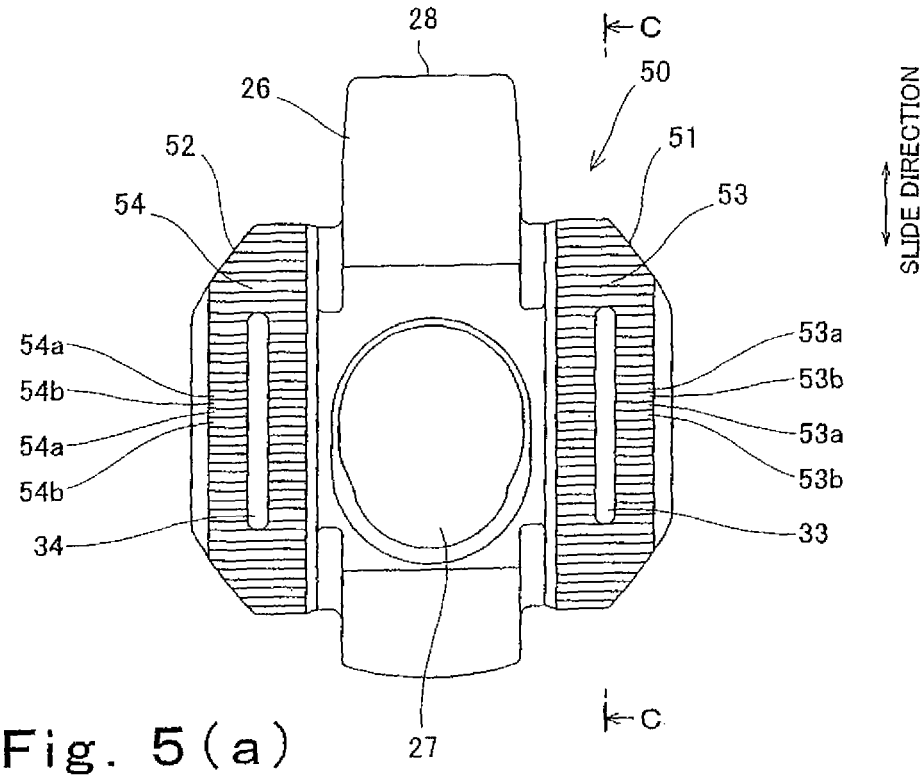
FIG. 5(*a*) is a plan view of the swash plate of Embodiment 3.
Figure 5B:
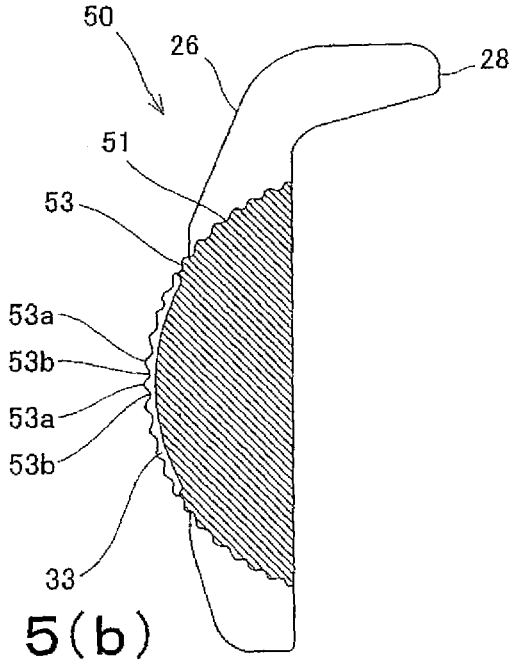

Next, Embodiment 3 will be explained. FIG. 5(*a*) is a plan view of a swash plate 50 of Embodiment 3, and FIG. 5(*b*) is a cross-sectional view taken along line C-C. The difference between Embodiments 1 and 3 is that laser quenching is carried out with respect to the swash plate 50.

As shown in FIGS. 5(*a*) and 5(*b*), in the swash plate 50, by irradiation of the laser light in a stripe pattern extending in a direction (width direction) perpendicular to the slide direction, quenched portions 53*a* and 54*a* are formed in a stripe pattern on circular-arc convex surfaces 53 and 54 (slide surfaces), respectively, of a pair of slide pressing portions 51 and 52 formed on both sides, respectively, of the insertion hole 27 of the swash plate main body 26. With this, the quenched portions 53*a* and 54*a* become convex by heat expansion, and the quenched portions 53*a* and 54*a* and non-quenched portions 53*b* and 54*b* form projections and depressions. Embodiment 3 is the same as Embodiment 1 except that: the swash plate support is made of cast iron which is subjected to the gas nitrocarburizing which causes nitrogen to diffusively intrude into the cast iron to harden its surface; and the circular-arc concave surface of the slide receiving portion is a smooth surface.

With the above configuration, as with Embodiment 1, the seizing resistance and the abrasion resistance of the swash plate 50 of the piston pump motor can be increased while significantly improving the productivity. The other configuration of Embodiment 3 is the same as that of Embodiment 1, so that an explanation thereof is omitted.

Embodiment 4

Figure 6:
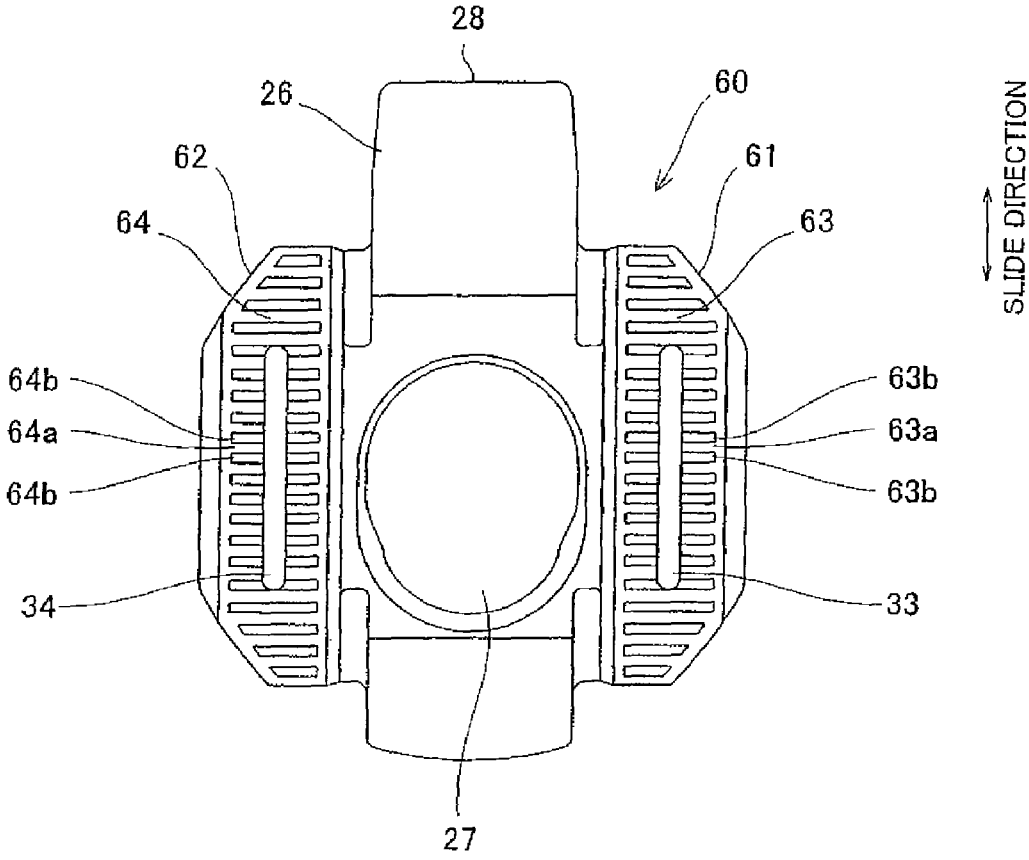
FIG. 6 is a plan view of the swash plate of Embodiment 4.

Next, Embodiment 4 will be explained. FIG. 6 is a plan view of a swash plate 60 of Embodiment 4. The difference between Embodiments 3 and 4 is the pattern of each of quenched portions 63*a* and 64*a* of convex surfaces 63 and 64 of the swash plate 60.

As shown in FIG. 6, in the swash plate 60, by pattern irradiation of the laser light, quenched portions 63*a* and 64*a* are formed on circular-arc convex surfaces 63 and 64 (slide surfaces), respectively, of a pair of slide pressing portions 61 and 62 formed on both sides, respectively, of the insertion hole 27. The quenched portions 63*a* and 64*a* are formed in a stripe pattern to extend in a direction (width direction) perpendicular to the slide direction, and also extend along outer peripheries, respectively, of the convex surfaces 63 and 64 so as to surround of the above stripe-pattern portion. By patterning the quenched portions 63*a* and 64*a* as above, non-quenched portions 63*b* and 64*b* are surrounded by the quenched portions 63*a* and 64*a*, respectively, to be formed in a stripe pattern. That is, respective lines of each of the non-quenched portions 63*b* and 64*b* are spaced apart from each other to extend in a direction perpendicular to the slide direction.

With the above configuration, the lubricating oil at an interface between the convex surface 61 of the swash plate 60 and the concave surface of the swash plate support and at an interface between the convex surface 62 of the swash plate 60 and the concave surface of the swash plate support is stuck in the non-quenched portions 63*b* and 64*b* that serve as recesses. Therefore, the non-quenched portions 63*b* and 64*b* achieve an effect of keeping the oil film, and the oil film is prevented from being damaged. Thus, the seizing resistance improves. The other configuration of Embodiment 4 is the same as that of Embodiment 1, so that an explanation thereof is omitted.

Embodiment 5

Figure 7:
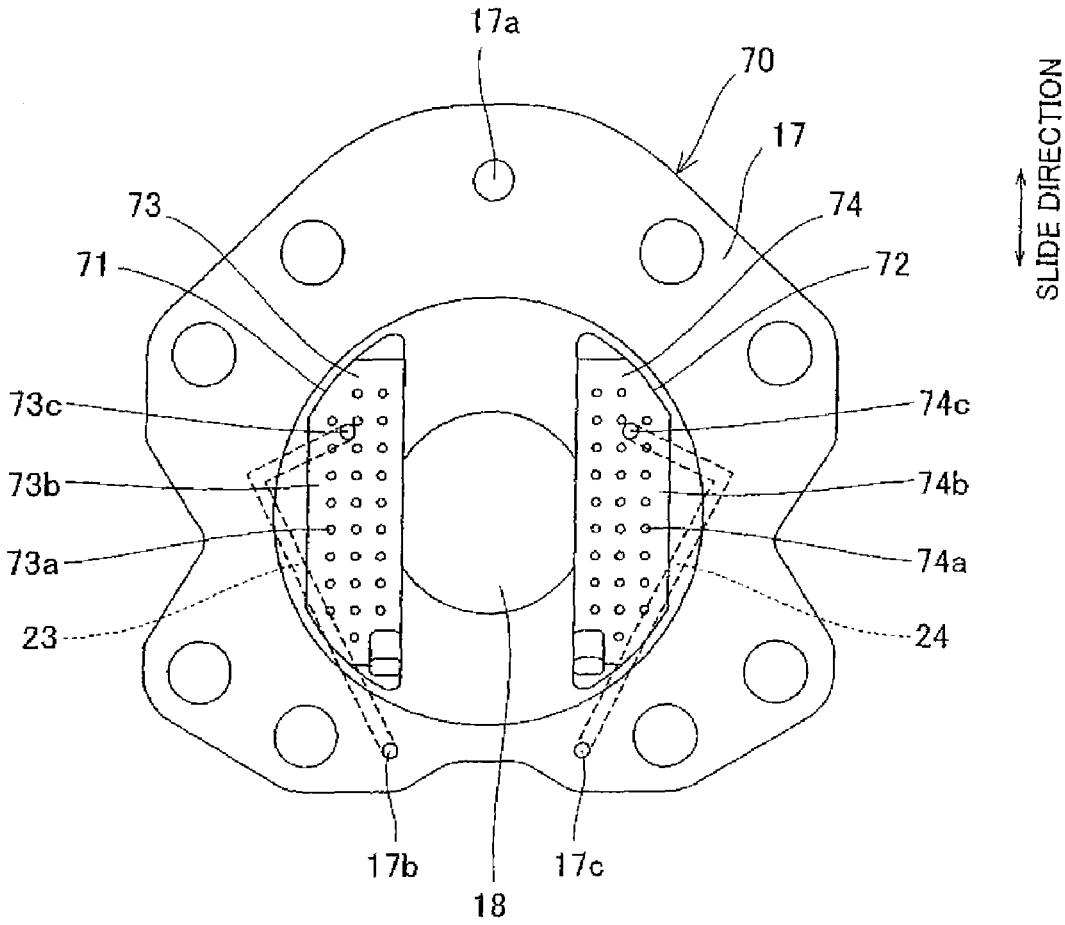
FIG. 7 is a plan view of the swash plate support of Embodiment 5.

Next, Embodiment 5 will be explained. FIG. 7 is a plan view of a swash plate support 70 of Embodiment 5. The difference between Embodiments 1 and 5 is the pattern of each of quenched portions 73*a* and 74*a* of concave surfaces 73 and 74 of the swash plate support 70.

As shown in FIG. 7, in the swash plate support 70 of the present embodiment, a pair of slide receiving portions 71 and 72 are convexly formed on both sides, respectively, of the insertion hole 18 of the plate portion 17, and circular-arc concave surfaces 73 and 74 (slide surfaces) of the slide receiving portions 71 and 72 are subjected to pattern irradiation with the laser light, so that the quenched portions 73*a* and 74*a* are formed on the concave surfaces 73 and 74, respectively. The quenched portions 73*a* and 74*a* are formed as a plurality of spots (spottings) which are equally spaced apart from one another in the slide direction and a direction perpendicular to the slide direction.

With the above configuration, the quenched portions 73*a* and 74*a* formed as the spots by utilizing the laser light become convex by the expansion caused by the structural transformation, so that the quenched portions 73*a* and 74*a* and the non-quenched portions 73*b* and 74*b* form projections and depressions. Therefore, the sliding property improves, and the seizing resistance increases. The other configuration of Embodiment 5 is the same as that of Embodiment 1, so that the same reference numbers are used for the same components, and explanations of those components are omitted. Although the present embodiment exemplifies the swash plate support, the same pattern as above may be quenched on the slide surface of the swash plate. Further, in the present embodiment, each of the quenched portions 73*a* and 74*a* has a circular shape, but may be a short oval shape.

Embodiment 6

Figure 8:
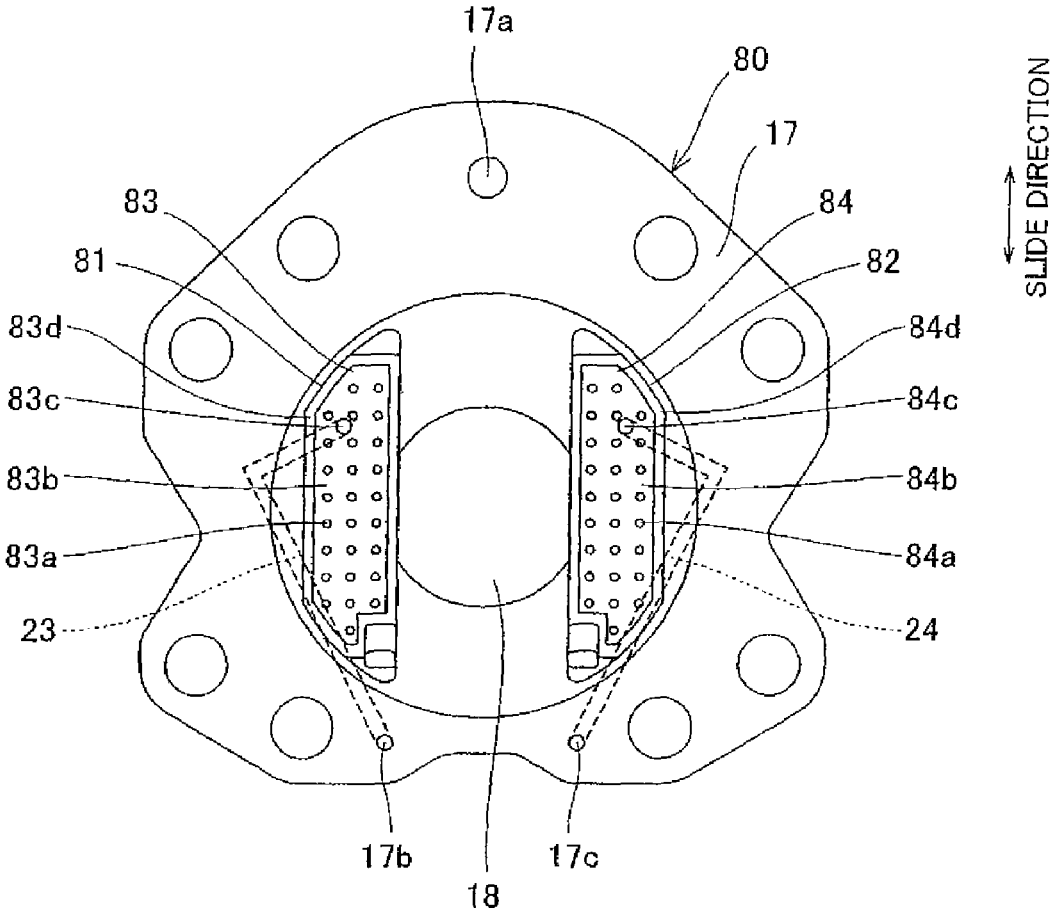
FIG. 8 is a plan view of the swash plate support of Embodiment 6.

Next, Embodiment 6 will be explained. FIG. 8 is a plan view of a swash plate support 80 of Embodiment 6. The difference between Embodiments 5 and 6 is the pattern of each of quenched portions 83*a* and 84*a* of concave surfaces 83 and 84 of the swash plate support 80.

As shown in FIG. 8, in the swash plate support 80 of the present embodiment, a pair of slide receiving portions 81 and 82 are convexly formed on both sides, respectively, of the insertion hole 18 of the plate portion 17, and circular-arc concave surfaces 83 and 84 (slide surfaces) of slide receiving portions 81 and 82 are subjected to pattern irradiation with the laser light, so that the quenched portions 83*a* and 84*a* are formed on the concave surfaces 83 and 84. The quenched portions 83*a* and 84*a* are formed as a plurality of spots (spottings) which are equally spaced apart from one another in the slide direction and a direction perpendicular to the slide direction, and the quenched portions 83*d* and 84*d* are linearly formed along outer peripheries, respectively, of the concave surfaces 83 and 84 to surround the above spot portion.

With the above configuration, the lubricating oil at interfaces of the concave surfaces 83 and 84 of the swash plate support 80 is stuck in the non-quenched portions 83*b* and 84*b* that serve as recesses. Therefore, the non-quenched portions 83*b* and 84*b* achieve an effect of keeping the oil film, and the oil film is prevented from being damaged. Thus, the seizing resistance improves. The other configuration of Embodiment 6 is the same as that of Embodiment 1, so that the same reference numbers are used for the same components, and explanations of those components are omitted. Although the present embodiment exemplifies the swash plate support, the same pattern as above may be quenched on the slide surface of the swash plate.

The invention claimed is:

1. A swash plate type piston pump motor in which: a plurality of pistons are arranged in a circumferential direction in a cylinder block configured to rotate with a rotating shaft; the pistons reciprocate such that tip end portions thereof are guided along a smooth surface of a swash plate; and the swash plate is slidably supported by a swash plate support so as to be able to tilt with respect to the rotating shaft, wherein:

a circular-arc smooth convex surface opposed to the swash plate support is formed on a surface of the swash plate, the surface being opposite to the smooth surface of the swash plate, and an oil film keeping groove portion extending in a slide direction is concavely formed on the convex surface;

the swash plate support closes one side-opening of a substantially tubular casing main body and constitutes a part of a casing, and a bearing for rotatably supporting the rotating shaft is internally fitted in the swash plate support and a holding member is attached on an outer side of the bearing;

a slide surface of the swash plate support is a circular-arc concave surface, the slide surface supporting the convex surface of the swash plate, and a pressure oil supply port which opens and faces the groove portion is formed on the concave surface;

the concave surface of the swash plate support includes a first quenched portion partially quenched by laser light; and the concave surface including the first quenched portion further includes a second quenched portion which is formed along an outer periphery of the concave surface so as to entirely surround the first quenched portion and a non-quenched portion in a closed loop shape.

2. The swash plate type piston pump motor according to claim 1, wherein the first quenched portion is formed in a stripe pattern.

3. The swash plate type piston pump motor according to claim 2, wherein respective lines of the first quenched portion extend in a direction perpendicular to a slide direction in which the swash plate slides on the swash plate support.

4. The swash plate type piston pump motor according to claim 1, wherein the first quenched portion is formed as a plurality of spots.

* * * * *